US009159184B2

(12) United States Patent
Okada

(10) Patent No.: US 9,159,184 B2
(45) Date of Patent: Oct. 13, 2015

(54) PERIPHERAL DEVICE AND METHOD OF DETECTING ILLEGAL ACTION

(75) Inventor: Kazuo Okada, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 1799 days.

(21) Appl. No.: 12/032,186

(22) Filed: Feb. 15, 2008

(65) Prior Publication Data

US 2008/0207319 A1 Aug. 28, 2008

(30) Foreign Application Priority Data

Feb. 16, 2007 (JP) ..... P2007-037020

(51) Int. Cl.
*G07F 17/00* (2006.01)
*G07F 17/32* (2006.01)

(52) U.S. Cl.
CPC ..... *G07F 17/32* (2013.01); *G07F 17/3241* (2013.01)

(58) Field of Classification Search
None
See application file for complete search history.

(56) References Cited

U.S. PATENT DOCUMENTS

| | | | | |
|---|---|---|---|---|
| 4,531,187 | A * | 7/1985 | Uhland | 463/12 |
| 5,801,766 | A * | 9/1998 | Alden | 348/157 |
| 6,142,876 | A * | 11/2000 | Cumbers | 463/25 |
| 6,612,928 | B1 * | 9/2003 | Bradford et al. | 463/29 |
| 7,210,998 | B2 * | 5/2007 | Kazaoka et al. | 463/29 |
| 7,255,642 | B2 * | 8/2007 | Sines et al. | 463/13 |
| 7,275,993 | B2 * | 10/2007 | Hosaka et al. | 463/34 |
| 2001/0036858 | A1 * | 11/2001 | McNutt et al. | 463/25 |
| 2002/0111205 | A1 * | 8/2002 | Beavers | 463/12 |
| 2002/0132663 | A1 * | 9/2002 | Cumbers | 463/25 |
| 2003/0125109 | A1 * | 7/2003 | Green | 463/29 |
| 2003/0211885 | A1 * | 11/2003 | Fujimoto | 463/29 |
| 2003/0236120 | A1 * | 12/2003 | Reece et al. | 463/42 |
| 2004/0105003 | A1 * | 6/2004 | Hosaka et al. | 348/157 |
| 2005/0064926 | A1 * | 3/2005 | Walker et al. | 463/16 |
| 2006/0177109 | A1 * | 8/2006 | Storch | 382/118 |
| 2006/0229128 | A1 * | 10/2006 | Walker et al. | 463/25 |
| 2006/0252534 | A1 * | 11/2006 | Walker et al. | 463/31 |
| 2006/0258422 | A1 * | 11/2006 | Walker et al. | 463/7 |
| 2006/0281537 | A1 * | 12/2006 | Abbott et al. | 463/25 |
| 2006/0281541 | A1 * | 12/2006 | Nguyen et al. | 463/25 |
| 2007/0238502 | A1 * | 10/2007 | Pokorny et al. | 463/12 |
| 2008/0045309 | A1 * | 2/2008 | Okada | 463/20 |
| 2008/0102937 | A1 * | 5/2008 | Fujimoto | 463/25 |
| 2008/0113783 | A1 * | 5/2008 | Czyzewski et al. | 463/29 |

FOREIGN PATENT DOCUMENTS

JP 2005-312510 11/2005

* cited by examiner

*Primary Examiner* — Paul A D'Agostino
(74) *Attorney, Agent, or Firm* — Lex IP Meister, PLLC

(57) ABSTRACT

A peripheral device (sandwiched device) to be installed adjacent to a gaming machine, including an imaging unit (CCD camera) configured to image a player who is playing a game with the gaming machine and output face image data for identifying the face of the player obtained by imaging, and a CPU configured to: obtain information about a game the player played with the gaming machine; determine whether or not an illegality condition is met based on the obtained information about the game; and set whether or not to activate the imaging unit based on the determination result.

8 Claims, 5 Drawing Sheets

PERIPHERAL DEVICE AND METHOD OF DETECTING ILLEGAL ACTION

CROSS REFERENCE TO RELATED APPLICATIONS

This application is based upon and claims the benefit of priority from the prior Japanese Patent Application No. 2007-037020, filed on Feb. 16, 2007, the entire contents of which are incorporated herein by reference.

BACKGROUND OF THE INVENTION

1. Field of the Invention

The present invention relates to a sandwiched device (peripheral device) installed adjacent to a gaming machine and, more particularly, to a method of detecting an illegal action for obtaining the face image of an illegal player using the sandwiched device.

2. Description of the Related Art

In a game arcade in which, for example, pachinko gaming machines or pachi-slot machines are installed, various systems are constructed in order to detect an illegal player. As an example, the system disclosed in Japanese Patent Application Laid-Open No. 2005-312510, the position of a player who moves about in a game arcade is detected, and the face image of the player is obtained based on the detected position and the gaming machine with which the player played a game is identified, and thus, an illegal action is detected and prevented.

In the above system, it is necessary to install a plurality of cameras on the ceiling etc. in the game arcade in order to detect the position of a player and obtain the image of the player's face, and because of the cost of installation, there is a certain limit to the reduction in cost of the entire system. In addition, a player who moves about in the game arcade does not necessarily move at a fixed speed at all times and the moving speed varies irregularly. When imaging in such circumstances, it is difficult to continue keeping an illegal player, who is a subject, in focus. As a result, there may be a case where it is not possible to image the face of an illegal player with high definition and in such a case, it is difficult to obtain information about an illegal action with high reliability. Further, it takes work and time to confirm which gaming machine the player having the imaged face played with and therefore it is difficult to efficiently detect an illegal action.

SUMMARY OF THE INVENTION

The present invention has been achieved in order to solve such problems and an object thereof is to provide a sandwiched device (peripheral device) and a method of detecting an illegal action at a low cost capable of efficiently obtaining information about an illegal action with high reliability by imaging the face of an illegal player with high definition.

A first aspect is a peripheral device to a gaming machine, the peripheral device comprising an imaging unit (for example, CCD camera) configured to image a player who is playing a game with the gaming machine and output face image data obtained by imaging, which identifies the face of the player, and a controller (for example, CPU) operable to: (a) obtain information about a game the player played with the gaming machine; (b) determine whether or not an illegality condition is met based on the obtained information about the game; and (c) set whether or not to activate the imaging unit based on the determination result of the illegality condition.

According to the first aspect, because the face of an illegal player can be imaged with high definition, it is possible to efficiently obtain information about an illegal action with high reliability. In addition, because it is possible to intensively comprise various units such as the imaging unit etc., the manufacturing cost of the device can be reduced considerably.

In a second aspect, the controller sets to activate the imaging unit when the illegality condition is met.

According to a second aspect, by activating the imaging unit when the illegality condition is met, the face image data for identifying the face of an illegal player can be output efficiently, and therefore, it is possible to efficiently obtain information about an illegal action with high reliability.

In a third aspect, there is provided an illegal action notification unit configured to notify information (for example, text information, audio information, animation/still image information) to the effect that the illegality condition has been met.

According to the third aspect, it is possible to detect and prevent an illegal action quickly and accurately by notifying the game arcade of the information about an illegal action.

In a fourth aspect, the information about the game includes the rotation time of the gaming machine, amount of used money, gaming time.

According to the fourth aspect, by dividing the illegality condition into pieces, the ability to analyze illegality can be improved, and therefore, it is possible to obtain information about an illegal action with high reliability.

A fifth aspect is a method of detecting an illegal action using a peripheral device to a gaming machine, comprising the steps of obtaining information about a game a player played with the gaming machine from the gaming machine by a controller provided in the peripheral device, determining whether or not the information about the game obtained by the controller meets an illegality condition by the controller provided in the peripheral device, and imaging a player who is playing a game with the gaming machine and outputting face image data that identifies the face of the layer obtained by imaging using an imaging unit provided in the peripheral device when the information about the game obtained by the controller meets the illegality condition based on the determination result by the controller.

According to the fifth aspect, the face of an illegal player can be imaged with high definition, and therefore, it is possible to efficiently obtain information about an illegal action with high reliability.

DETAILED DESCRIPTION OF THE EMBODIMENT

A sandwich device (peripheral device) according to an embodiment of the present invention is explained below with reference to the accompanied drawings.

Figure 1:
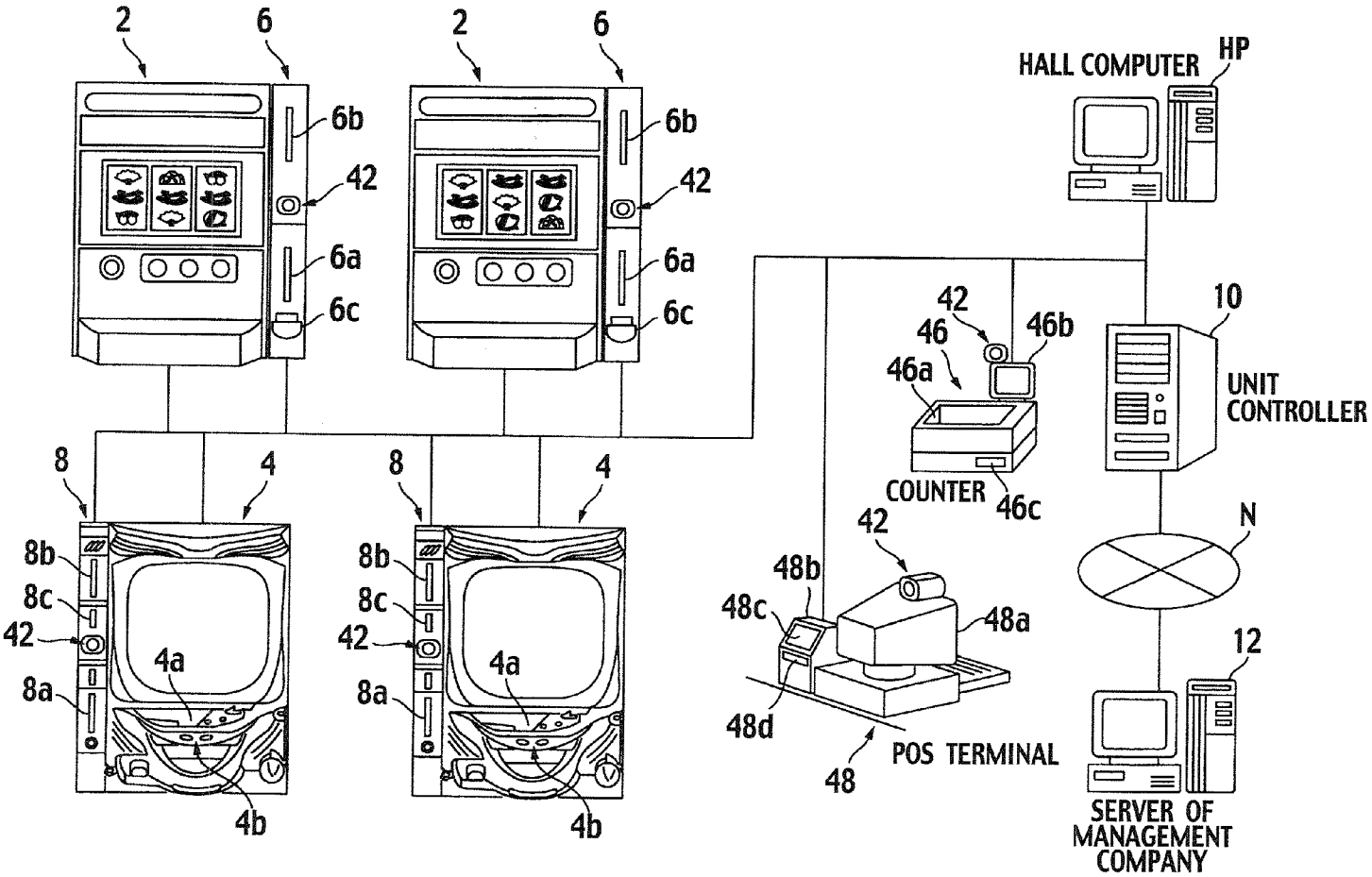
FIG. 1 is a diagram showing a system configuration in a game arcade in which a sandwiched device according to an embodiment of the present invention is installed adjacent to a gaming machine.

FIG. 1 shows a system configuration example of a game arcade in which a sandwiched device according to the present embodiment is installed, and in the game arcade, a plurality of kinds of gaming machine are installed.

In this case, as a gaming machine, a gaming machine of ball-hitting type (for example, a pachinko gaming machine), a gaming machine of rotary type (for example, a pachi-slot machine, slot machine), etc., can be applied, and here, as an example of a gaming machine, a pachi-slot machine 2 and a pachinko gaming machine 4 are supposed.

As shown in FIG. 1, adjacent to the pachi-slot machine 2 and the pachinko gaming machine 4, a predetermined sandwiched device (a sandwiched device for pachi-slot gaming machine 6 and a sandwiched device for pachinko gaming machine) is installed, respectively. Each of the sandwiched devices 6, 8 is connected, for example, to a unit controller 10 that manages the system and sales of the sandwiched devices 6, 8 so that communication is possible. The unit controller 10 is installed in each game arcade and connected to a server 12 of a managing company that manages each of the sandwiched devices 6, 8 over a predetermined network N (for example, LAN (Local Area Network), Internet, etc.) so that communication is possible (for example, notification of sales is possible).

Each of the sandwiched devices 6, 8 is provided with a card insertion slot (for example, 6*a*, 8*a*) capable of accepting a prepaid card issued from, for example, a card issuing machine (not shown) in the game arcade or a member card issued to a person who desires to be a member at a registration counter (not shown) in the game arcade, etc., and a bill insertion slot (for example, 6*b*, 8*b*) through which a bill can be inserted. It is possible for a player to rent a gaming medium (medal, gaming ball) required to play a game by inserting his/her member card (prepaid card) or bills of a predetermined amount of money into the card insertion slot 6*a*, 8*a* or the bill insertion slot 6*b*, 8*b*.

In this case, in the sandwiched device for pachi-slot machine 6, by driving a hopper using a hopper drive motor, not shown, a predetermined number of medals is paid out onto a receiving tray 6*c* from a medal tank. On the other hand, in the sandwiched device for pachinko gaming machine 8, by driving a payout device (solenoid), not shown, a predetermined number of gaming balls are paid out on an upper tray 4*a* of the pachinko gaming machine 4. After that, the player plays a game using the paid out gaming media (medals, gaming balls). At this time, information about a game output from the gaming machines 2, 4 (for example, the rotation time of the gaming machine, amount of used money, gaming time, or number of times of special winning or big bonus, etc.) is managed by a hall computer HP for each of the gaming machines 2, 4.

Here, a specific configuration in which the gaming machine and the sandwiched device are installed adjacent to each other is explained with an example of the sandwiched device for pachinko gaming machine and the pachinko gaming machine 4.

Figure 2:
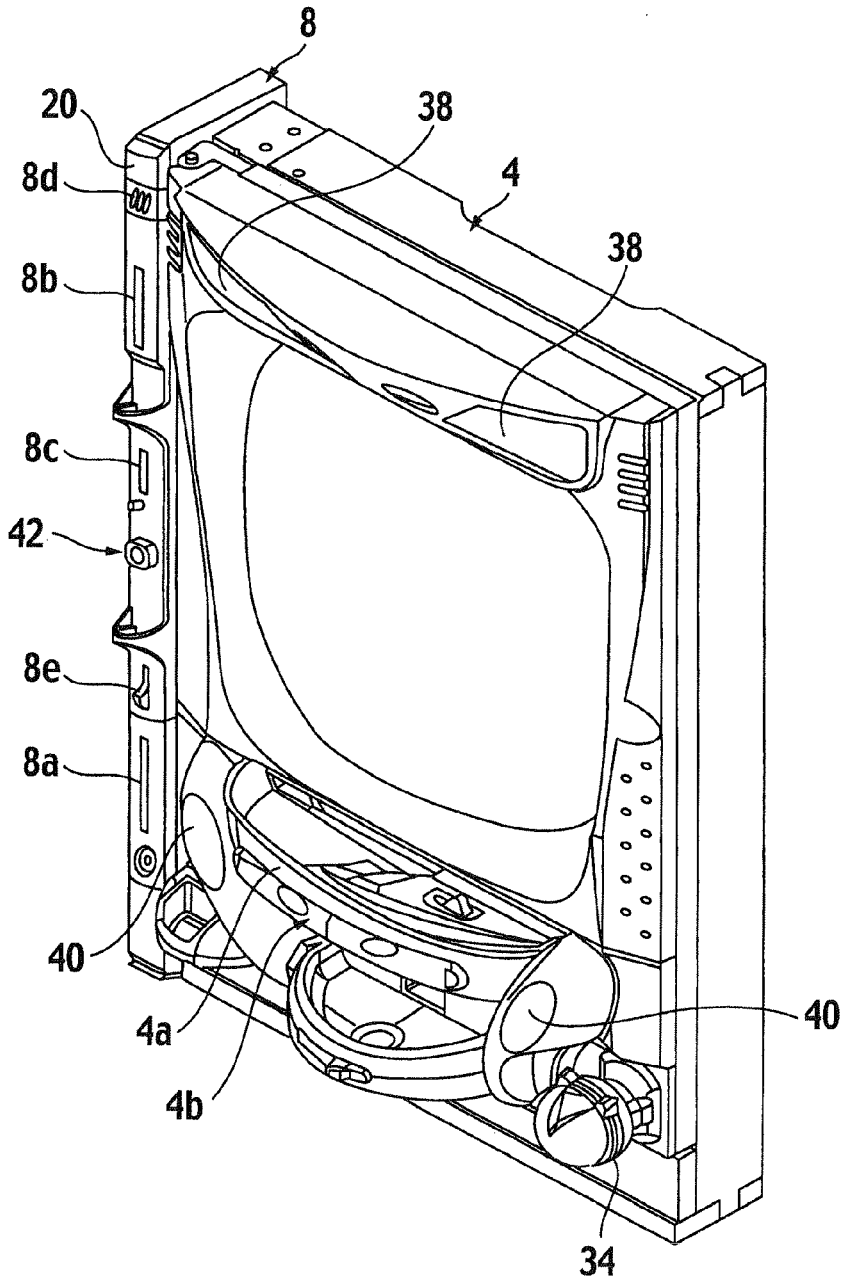
FIG. 2 is a perspective view showing an external shape of a sandwiched device installed adjacent to a gaming machine.
Figure 3:
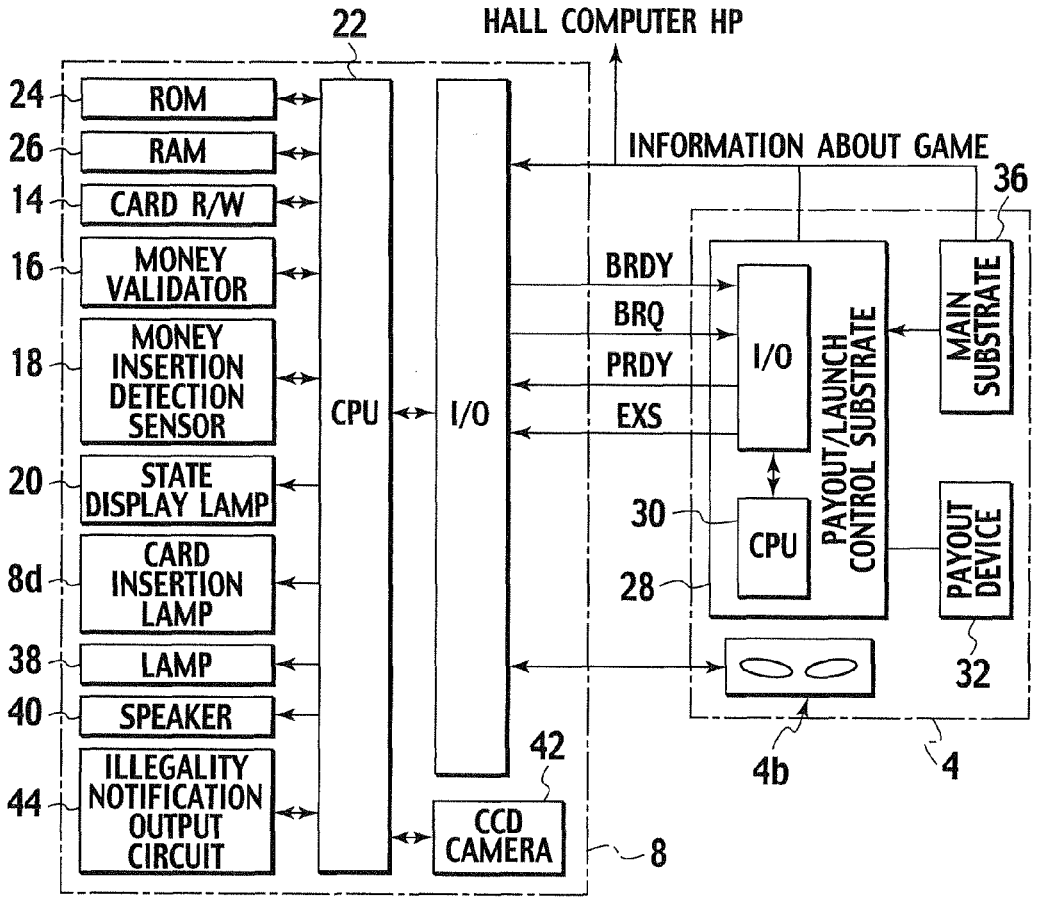
FIG. 3 is a block diagram showing an internal configuration of a sandwiched device installed adjacent to a gaming machine.

As shown in FIG. 2 and FIG. 3, the sandwiched device 8 comprises a coin insertion slot 8*c* in addition to the above-mentioned card insertion slot 8*a* and the bill insertion slot 8*b*, and it is possible for a player to rent the gaming media (that is, gaming balls) necessary for a game and play a game by inserting a prepaid card (member card) into the card insertion slot 8*a* or inserting money (bill, coin) of a predetermined amount of money into the bill insertion slot 8*b* or the coin insertion slot 8*c*.

In addition, the sandwiched device 8 is provided with a card insertion lamp 8*d* that emits light in a state in which a prepaid card (member card) is inserted in the card insertion slot 8*a*, a card R/W 14 that reads various kinds of information recorded in a prepaid card (member card) a money validator 16 that validates money (bill, coin) inserted into the bill insertion slot 8*b* and the coin insertion slot 8*c*, a money insertion detection sensor 18 that detects that money (bill, coin) has been inserted through the bill insertion slot 8*b* and the coin insertion slot 8*c*, and a state display lamp 20 that displays the operation state of the sandwiched device 8 and all of these are controlled by a CPU (controller) 22. The control is executed in the CPU 22 by a control program stored in, for example, a ROM 24, using a RAM 26 as a working area. When money (bill, coin) is identified to be counterfeit by the money validator 16, the counterfeit bill is returned from the bill insertion slot 8*b*. The counterfeit coin is selected by a selector, not shown, and returned from a coin return opening 8*e*.

The sandwiched device 8 is connected to the pachinko gaming machine 4 via cable, not shown, and various communications can be established via the cable. For example, when a ball rent operation panel 4*b* of the pachinko gaming machine 4 is operated, signals (BRDY, BRQ, PRDY, EXS) relating to ball rent processing are communicated between the CPU 22 of the sandwiched device 8 and a payout/launch control substrate 28 of the pachinko gaming machine 4. At this time, a CPU 30 of the payout/launch control substrate 28 drives and controls a payout device 32 so that a predetermined number of gaming balls are paid out onto the upper tray 4*a* of the pachinko gaming machine 4 from the payout device 32.

With the pachinko gaming machine 4, when a handle lever 34 is operated, a solenoid (not shown) is activated and a gaming ball is launched into a gaming area along a guide rail (not shown), and thus, a game is played (base gaming mode). In the base gaming mode, for example, when a gaming ball comes into a regular winning opening (not shown), a predetermined command is transmitted from a main substrate 36 to the payout/launch control substrate 28 and the CPU 30 of the payout/launch control substrate 28 drives and controls the payout device 32 based on the command, and thereby, a predetermined number of gaming balls is paid out onto the upper tray 4*a* from the payout device 32. In addition, for example, when a gaming ball comes into a start chucker (not shown) and a predetermined combination of symbols is achieved, a special gaming mode advantageous to a player (for example, a special winning gaming mode when a special winning is won, a variable probability gaming mode in which the probability of winning becomes variable is won, etc.) is entered and through the same payout control, a predetermined number of gaming balls is paid out.

In such gaming modes, the information (for example, the rotation time of the gaming machine, amount of used money, gaming time, or the number of possible combinations of symbols, number of times of special winnings, number of variable probability states, etc.) about the game output from the pachinko gaming machine 4 (the main substrate 36) is transmitted to the hall computer HP (FIG. 1) and managed for each pachinko gaming machine 4. The information about the game is transmitted also to the sandwiched device 8 and used as analysis data of an illegal action, to be described later. The pachinko gaming machine 4 is provided with a lamp 38 and a speaker 40 and in accordance with a gaming mode, an effect by the light from the lamp 38 is brought about or an effect by the sound from the speaker 40 is brought about.

In the above-mentioned gaming modes, if an illegal game is played, it is necessary to obtain the information about the illegal action by identifying a player (illegal player) who has played an illegal game from among a large number of players in the game arcade. To this end, it is recommended to identify the illegal player from among the large number of players in the game arcade and image the face of the illegal player with high definition. Due to this, highly reliable information about an illegal action can be obtained efficiently, and therefore, it is possible to prevent an illegal action by quickly and accurately detecting the illegal action.

Because of this, as shown in FIG. 1 to FIG. 4, the sandwiched device in the present embodiment comprises an imaging unit that images a player who is playing a game with a gaming machine (the pachi-slot machine 2, the pachinko gaming machine 4) and outputs face image data that identifies the face of the player obtained from imaging, an acquisition unit that obtains information about the game when the player has played the game with the gaming machines 2, 4, a determination unit that determines whether or not the illegality condition is met based on the information about the game obtained by the acquisition unit, and a setting unit that sets whether or not to activate the imaging unit.

The imaging unit is provided in the sandwiched devices 6, 8 and capable of imaging a player who is playing a game with the gaming machines 2, 4 installed adjacent to the sandwiched devices 6, 8. The pachinko gaming machine 4 is connected via a cable (not shown) with the sandwiched device 8 on the left-hand side when viewed from the player who is playing a game with the pachinko gaming machine 4 and both can communicate with each other. As a result, the player who is playing a game with the pachinko gaming machine 4 is imaged by the imaging unit installed in the sandwiched device 8 on the left-hand side when viewed from the player. On the other hand, because the positional relationship between the pachi-slot machine 2 and the sandwiched device for pachi-slot machine 6 is laterally reverse (FIG. 1), the player who is playing a game with the pachi-slot machine 2 is imaged by the imaging unit provided in the sandwiched device 6 on the right-hand side when viewed from the player.

As the imaging unit, various cameras that incorporate an imaging device (photo-electric conversion device), such as a CCD (Charge Coupled Device), a CMOS (Complementary Metal-Oxide Semiconductor), etc., can be applied, however, a CCD camera 42 is supposed here as an example. In this case, it is possible to position the CCD camera 42 in the sandwiched devices 6, 8 in a state in which its imaging direction is fixed being directed toward the player who is playing a game with the gaming machines 2, 4. In this case, the imaging area of the CCD camera 42 is adjusted in advance to the area that includes at least the face of the player who is playing a game with the gaming machines 2, 4. Although the position of the face of a player somewhat differs depending on the height of the player, it is possible to define the imaging area to a certain area in front of the gaming machines 2, 4. As a result, by adjusting in advance the imaging area of the CCD cameral 42 so as to cover the area, it is possible to image without fail the face of the player who is playing a game with the gaming machines 2, 4.

By setting one of specifications of the CCD camera, for example, the depth of field shallower (to a smaller value), the background of the player can be brought into an out-of-focus state, and therefore, it is possible to image the face of the player clearly. In this case, in order to set the depth of field shallower (to a smaller value), a lens with a long focal length is used, for example, and the aperture is set fully open (to brighter). By setting the resolution of the CCD camera 42 higher, for example, the face of the player can be imaged with high definition, and therefore, it is possible to output high-quality face image data with high reliability from the CCD camera 42. Due to this, it is possible to identify without fail the face of the player based on the face image data. The depth of field and the resolution can be set arbitrarily in accordance with the purposes of the use of the CCD camera 42 and the use conditions, and therefore, they are not specified in particular here.

A different unit number is assigned to each of the gaming machines 2, 4 installed adjacent to the sandwiched devices 6, 8 and it is possible to overlap the unit number data that can identify the unit number of each of the gaming machines 2, 4, the data of imaging date, such as the imaging date, imaging time, etc., on the face image data to be output from the CCD camera 42. Due to this, it is possible to grasp (identify) the gaming machines 2, 4 with which the imaged player is playing a game real time and at the same time, to accurately grasp (identify) the history of the gaming machines 2, 4 with which the player had played a game in the past. The face image data on which the unit number data and the imaging date data are overlapped will become large capacity information, and therefore, it is necessary to increase to a certain level the capacity of a storage in which the data is stored. In this case, as a storage unit, for example, the hard disc (not shown) of the sandwiched devices 6, 8 or the hall computer HP may be used, or a database for storage (not shown) may be constructed in the game arcade separately.

Figure 4A:
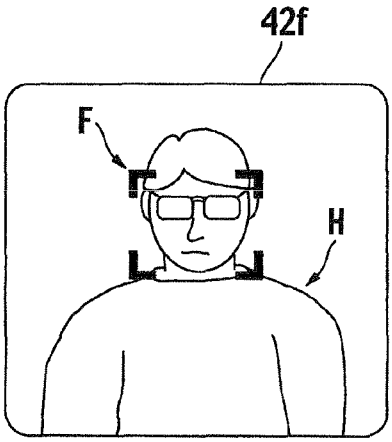
FIG. 4A is a diagram showing a state in which a frame is set in accordance with the face of a subject in an imaging area of an imaging unit.

It is preferable for the CCD cameral 42 to mount a face recognition function already developed by various camera manufacturers. The face recognition function is a function of recognizing a human face among subjects, automatically focusing thereon, and also adjusting exposure. Due to this, for example, if a subject H comes into an imaging area 42*f* of the CCD camera 42 as shown in FIG. 4A, a frame F adjusted to the size of the face of the subject H is automatically set and a state in which the face in the frame F is in focus is brought about. Then, for example, even if the position of the face changes as the subject H moves, the frame F automatically moves to follow the face, and therefore, a state in which the face of the subject H is always in focus is maintained as described in FIG. 4B. Because of this, even if imaging is carried out with an arbitrary timing, it is possible to image the face of an illegal player (subject) with high definition.

Supposing the pachinko gaming machine 4 as a gaming machine, the acquisition unit obtains information about the game (for example, the rotation time of the gaming machine, amount of used money, gaming time, or the number of possible combinations of symbols, the number of times of special winnings, number of variable probability states, etc.) output from the main substrate 36 when a player plays a game with the pachinko gaming machine 4. Here, when the CPU 22 of the sandwiched device for pachinko gaming machine 8 is applied as the acquisition unit, the information about the game output from the main substrate 36 is taken into the CPU 22 of the sandwiched device 8. At this time, the information about the game taken into the CPU 22 is stored, for example, in the memory (not shown) of the CPU 22.

Supposing the pachinko gaming machine 4 as a gaming machine, the information about the game taken in the CPU 22 of the sandwiched device 8 determines whether or not the predetermined illegal condition is met. In this case, as the determination unit, a determination circuit (not shown) may be constructed separately in the sandwiched device 8 or the CPU 22 may be applied. As an example, if the CPU 22 is applied, the determination as to whether or not the illegal condition is met is executed in the CPU 22 by a determination program stored, for example, in the ROM 24 using the RAM 26 as a working area.

The illegal condition may be set arbitrarily based on the information about the game, such as, for example, the rotation time of the gaming machine, amount of used money, gaming time, or the number of possible combinations of symbols, number of times of special winnings, number of variable probability states, etc. For example, if a case is supposed, where the "amount of used money" when a player rents gaming balls by operating the operation panel 4*b* and plays a game is set as an illegality condition, the determination unit determines, for example, whether or not the amount of money received corresponds to the number of gaming balls rented. In this case, for example, when the amount of money received is "one hundred yen", then, the number of gaming balls to be rented is 25 if it is assumed that a gaming ball costs four yen. However, if the number of gaming balls actually used is 30, then, the amount of money received does not correspond to the number of gaming balls rented. At this time, the determination unit determines that the number of gaming balls used is more than that corresponding to the amount of money received, and it is determined that the illegality condition has been met.

In addition, when the pachi-slot machine 2 is supposed as a gaming machine and if the "amount of used money" when a player rents gaming balls by operating the operation panel 4*b* and plays a game is set as an illegality condition, the determination unit determines, for example, whether or not the amount of money received corresponds to the number of gaming balls rented.

For example, if a case is supposed, where the "gaming time" during which a player is playing a game with the pachinko gaming machine 4 is set as an illegality condition, the determination unit counts the time, for example, which is the operation time of the solenoid when a gaming ball is launched multiplied by the number of gaming balls rented. In this case, if it is assumed that an operation time S when a gaming ball is launched is constant, when the number of gaming balls rented is 25, a reference gaming time required for launching 25 gaming balls is calculated as "25×S" at maximum. However, if the actual number of gaming balls used is, for example, 30 without the operation of renting further gaming balls after the initial operation of renting (25 gaming balls), the actual gaming time will be "30×S", exceeding the reference gaming time. At this time, the determination unit determines that "30S>25S" because more than the number of gaming balls rented has been launched, and it can be determined that the illegal condition has been met.

Further, supposing a case where the "rotation time of the gaming machine" is set as an illegal condition, the determination unit counts the number of times the lottery for special winning is held. In this case, if it is assumed that a rotating time T during which the lottery for special winning is held when a gaming ball comes into a start chucker is constant, when the number of gaming balls rented is 25, a reference rotation time during which the lottery for a special winning is held when all of the gaming balls come into the start chucker is calculated as "25×T" at maximum. However, if the actual number of gaming balls that come into the start chucker is, for example, 30 without the operation of renting further gaming balls after the initial operation of renting (25 gaming balls), the actual rotation time will be "30×T", exceeding the reference gaming time. At this time, the determination unit determines that "30T>25T" because more than the number of gaming balls rented come into the start chucker, and it can be determined that the illegal condition has been met.

Supposing the pachinko gaming machine 4 as a gaming machine, the setting unit sets whether or not to activate the imaging unit (CCD camera 42) based on the determination result by the determination unit (CPU 22). Here, as the setting unit, a setting circuit (not shown) may be constructed separately in the sandwiched device 8 or the CPU 22 may be applied. As an example, when the CPU 22 is applied, the setting as to whether or not to activate the imaging unit (CCD camera 42) is executed in the CPU 22 by the setting program stored, for example, in the ROM 24, using the RAM 26 as a working area. In this case, the setting unit (CPU 22) sets so that the imaging unit (CCD camera 42) is activated when the above illegality condition determined by the determination unit (CPU 22) is met.

Next, the operation of the sandwiched device in the present embodiment described above is explained. The sandwiched device for pachinko gaming machine 8 installed adjacent to the pachinko gaming machine 4 is supposed here as an example. As to an illegality condition, a case is supposed, where the "amount of used money" when a player rents 25 gaming balls by operating the operation panel 4*b* and plays a game is set as an illegality condition. In this case, the determination unit (CPU 22) determines whether or not, for example, the amount of money received corresponds to the number of gaming balls rented.

When a player operates the handle lever 34 (FIG. 2) of the pachinko gaming machine 4, a solenoid (not shown) is activated by the payout/launch control substrate 28 (FIG. 3) and a gaming ball is launched one by one into the gaming area. At this time, the solenoid operation signal (information about the game) is output sequentially from the payout/launch control substrate 28 and input to the acquisition unit (CPU 22) of the sandwiched device 8. When the number of gaming balls rented is 25, the solenoid activation signal is input to the acquisition unit (CPU 22) 25 times.

Figure 5:
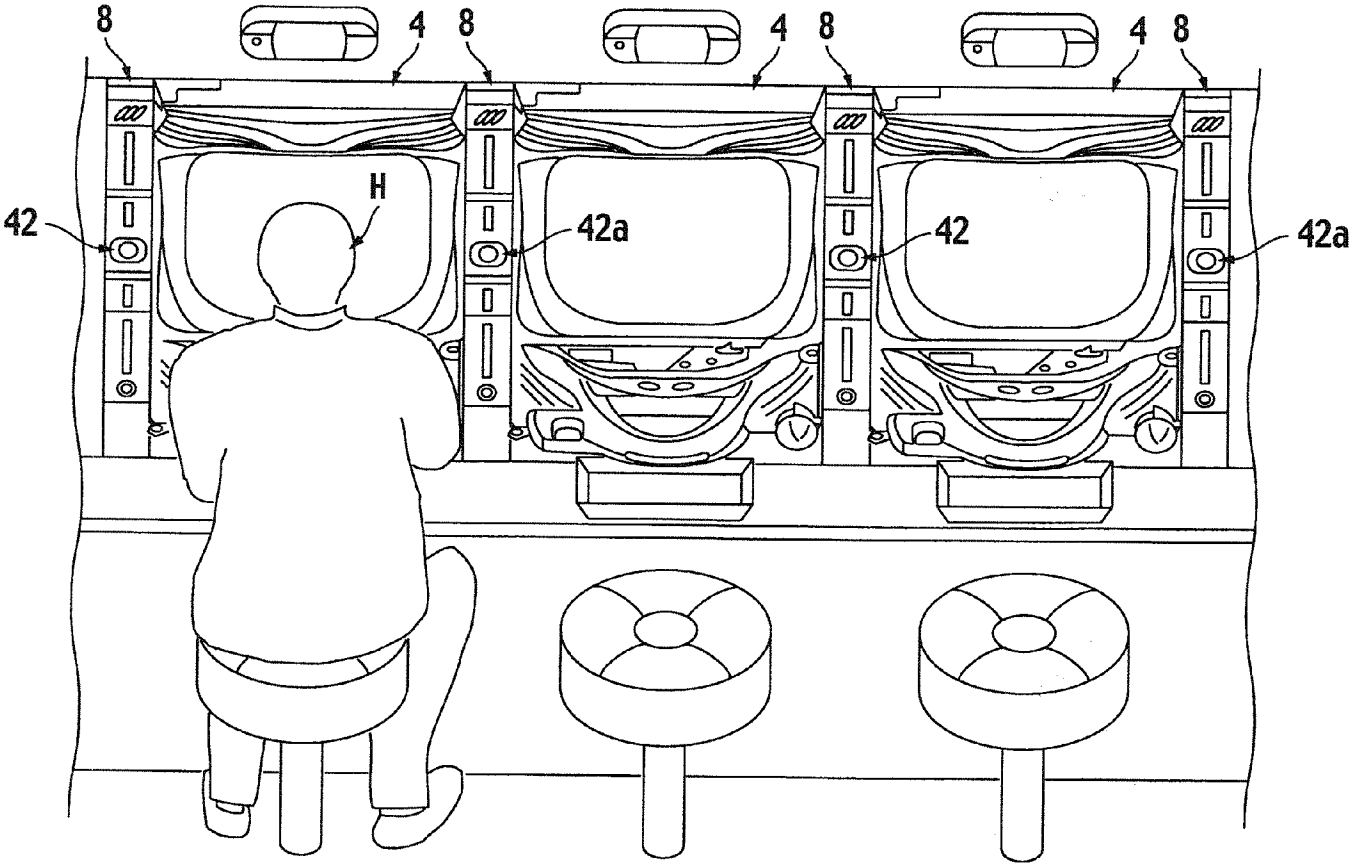
FIG. 5 is a diagram showing a state in which a player is playing a game with a gaming machine adjacent to which a sandwiched device is installed.

In the meantime, the determination unit (CPU 22) determines whether or not the amount of money received corresponds to the number of gaming balls rented based on the input solenoid activation signal(s). If the solenoid activation signal is input to the acquisition unit (CPU 22), for example, 30 times in actuality, the determination unit (CPU 22) determines that the amount of money received does not correspond to the number of gaming balls rented. In other words, the determination unit (CPU 22) determines that the number of gaming balls used is more than that corresponding to the amount of money received, and therefore it is determined that an illegality condition has been met. In this case, it is determined that there is some illegal action as to the operation of renting gaming balls by the sandwiched device 8 and as a result, the player who is playing a game with the pachinko gaming machine 4 installed adjacent to the sandwiched device 8 is identified as the illegal player H (FIG. 5).

Figure 4B:
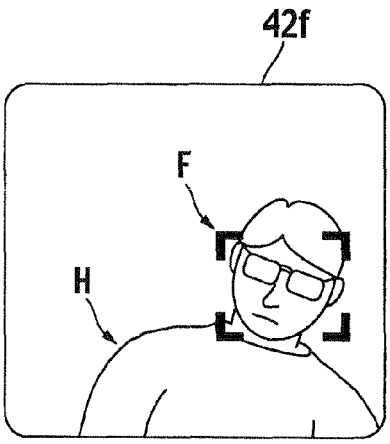
FIG. 4B is a diagram showing a state in which the frame has moved following the change in the position of the face of the subject.

At this time, the setting unit (CPU 22) sets so that the activation of the imaging unit (CCD camera 42) is triggered when the illegality condition determined by the determination unit (CPU 22) is met. In synchronization with this, the CCD camera 42 images the illegal player H (FIG. 5) who is playing a game with the pachinko gaming machine 4. In this case, the imaging area 42 (FIG. 4A) of the CCD camera 42 on the left-hand side when viewed from the illegal player H is adjusted in advance so as to include at least the face of the illegal player who is playing a game with the gaming machine 4 and remains in a state in which the face in the frame F is in focus even if the position of the face changes as the illegal player H moves (FIG. 4B).

Due to this, it is possible to image the face of the illegal player H without blur but with high definition even if imaging is carried out with an arbitrary timing. Because of this, face image data of high quality and with high reliability capable of identifying the face of the player is output from the CCD camera 42 as illegal action information. In this case, it is possible for the illegal action information to include the unit umber data and imaging date data overlapped on the face data together with the face image data that specifies the face of the illegal player H. As a result, by obtaining such illegal action information with high reliability, it is possible to grasp (identify) the face of the illegal player H, the pachinko gaming machine 4 with which the illegal player H played a game, the data when the illegal game was played in a realtime manner and their history both accurately and efficiently.

Further, it is possible for the sandwiched device 8 to intensively comprise the imaging unit (CCD camera 42) and various units (CPU 22) such as the acquisition unit, the determination unit, the setting unit, etc. In this case, it is no longer necessary to install a plurality of cameras on the ceiling etc. of the game arcade as before and therefore the manufacturing cost of the machine can be reduced considerably. In addition, when the maintenance of the imaging unit (CCD camera 42) and various units (CPU 22) is carried out, it is possible to carry out the maintenance for each sandwiched device 8 and the task or time for the maintenance is not necessary, and therefore, the maintenance cost can be suppressed low.

Furthermore, by setting the "amount of used money" as an illegality condition, the ability to analyze illegality can be improved, and therefore, it is possible to improve the reliability of the information about illegal action to be obtained. In this case, by adding other conditions, such as the "gaming time" and the "rotation time of gaming machine", as an illegality condition or by combining them arbitrarily, the ability to analyze illegality is further improved and as a result, it is possible to further improve the reliability of information about illegal action to be obtained. The illegality conditions are not limited to those in the above embodiments and it is obvious that an illegal condition can be set arbitrarily according to, for example, the content and kind of a game.

By the way, it is preferable to notify the game arcade of the information about illegal action (for example, face image data, unit number data, imaging date data, etc.) obtained in the manner described above in order to detect and prevent illegal actions. Because of this, the sandwiched devices 6, 8 in the present embodiment are provided with an illegality notification unit that notifies information to that effect that an illegality condition determined by the determination unit has been met. FIG. 3 shows an example of the illegality notification unit constructed in the sandwiched device for pachinko gaming machine 8.

As shown in FIG. 3, the sandwiched device 8 is additionally provided with an illegality notification output circuit 44 as the illegality notification unit and when information about illegal action (for example, face image data, unit number data, imaging date data, etc.) is output from the CCD camera 42, information to the effect that the illegality condition has been met is notified to the game arcade from the illegality notification output circuit 44. In this case, the information to the effect that the illegality condition has been met can be notified after being converted into, for example, text information, audio information, animation/still image information, etc., so that it is suitable to, for example, the system environment, the purpose of its use, etc., of the game arcade.

For example, text information such as "there was an illegal action at the pachinko gaming machine with the gaming machine unit number xx at pm xx:xx on xx (day), xx (month)" or still image information of the face of the illegal player can be notified to the monitor in the game arcade, or information indicative of the same contents can be notified to the intercom (communication device) carried by an employee in the game arcade. It is also possible to notify the animation information of the illegal player who is playing a game to the monitor in the game arcade. Further, it may also be possible to totally notify the information to the effect that such an illegality condition has been met to the hall computer HP for management.

Due to this, it is possible to remotely monitor the illegal action of an illegal player in a realtime manner without the need for an employee to directly go to the gaming machine at which the illegal action is taken. As a result, it is possible to detect and prevent an illegal action quickly and accurately while reducing the burden on the game arcade side. Instead of additionally providing the illegality notification output circuit 44 as an illegality notification unit to the sandwiched device 8, it may also be possible to, for example, cause the ROM 24 to store an illegality notification output program and execute the illegality notification output program in the CPU 22 using the RAM 26 as a working area when illegality action information is output from the CCD cameral 42.

In the above embodiment, the configuration in which the imaging unit (CCD camera 42) is provided in the sandwiched devices 6, 8 is shown as an example, however, this is not limitative, and it is possible to provide the imaging unit (CCD camera 42) at any position as long as imaging of an illegal player is possible. For example, as shown in FIG. 1, it may also be possible to provide the imaging unit (CCD camera 42) at a counter 46 and a POS terminal 48, respectively, installed in the game arcade to image the face of the relevant illegal player.

The counter 46 is provided with a winning ball acceptance opening 46*a*, a counter display 46*b*, and a card insertion slot 46*c* that accepts, for example, a member card, a visitor card, etc. In this case, in a state in which a member card (visitor card) is inserted into the card insertion slot 46*c*, by putting the obtained winning balls into the winning ball acceptance opening 46*a*, it is possible to cause the counter display 46*b* to display the total number of winning balls and at the same time, a receipt (not shown) on which the number of obtained balls is printed is issued.

At this time, if the information to the effect that the illegality condition has been met as described above is notified from the sandwiched devices 6, 8 to the hall computer HP and totally managed, it is possible to refer to the hall computer HP about the information recorded in the member card (visitor card) to determine whether or not the player is an illegal player. Then, when the result of the reference is affirmative, it is possible to image the face of the illegal player by, for example, outputting an activation signal from the hall computer HP to the counter 46 to activate the imaging unit (CCD camera 42). Due to this, it is possible to obtain information about illegal action with high reliability as a corroborating photograph of the illegality at the time of counting.

Further, the POS terminal 48 comprises a premium exchange processing device 48*a* to read the receipt issued from the counter 46 and a display device 48*b* to display the result of the premium exchange processing to the player, and the display device 48*b* is provided with a display unit 48*c* to display the content of the premium exchange and a card insertion slot 48*d* to accept a member card (visitor card). In this case, it is possible for an employee who has received a receipt from a player who carries the receipt to exchange with a premium the player desires by causing the POS terminal 48 to read the receipt.

At this time, if the information to the effect that the illegality condition has been met as described above is notified from the sandwiched devices 6, 8 to the hall computer HP and totally managed, it is possible to refer to the hall computer HP about the information recorded in the member card (visitor card) to determine whether or not the player is an illegal player. Then, when the result of the reference is affirmative, it is possible to image the face of the illegal player by, for example, outputting an activation signal from the hall computer HP to the POS terminal 48 to activate the imaging unit (CCD camera 42). Due to this, it is possible to obtain information about illegal action with high reliability as a corroborating photograph of the illegality at the time of premium exchange.

In the embodiment described above, the case is supposed, where the direction of imaging by the imaging unit (CCD camera 42) is fixed toward the player who is playing a game with the gaming machines 2, 4, however, it may also be possible to configure the imaging system so that the direction of imaging can be adjusted. For example, as shown in FIG. 5, when the illegal player H is playing an illegal game with the pachinko gaming machine 4, in the embodiment described above, the imaging is carried out by the imaging unit (CCD camera 42) of the sandwiched device 8 on the left-hand side when viewed from the illegal player H. In this case, the direction of imaging of the imaging unit (CCD camera 42*a*) of the sandwiched device 8 on the right-hand side when viewed from the illegal player H is adjusted and positioned so that it is directed toward the illegal player H.

As a method of adjusting the direction of imaging of the CCD camera 42*a*, it is only required to, for example, position the CCD camera 42*a* so that it is directed toward the illegal player H by moving the lens (not shown) built in the CCD camera 42*a* by an actuator (not shown). As an actuator, for example, a voice coil motor, piezo motor, DC motor, etc., commercially available, can be applied. As a method of activating an actuator, it may be possible to remotely control the actuator built in each sandwich device 8 using a management system (not shown) installed in the game arcade, or it may also be possible to activate the actuator built in each sandwiched device 8 by the key input from the terminal of the hall computer HP.

As to the amount of movement (angles) of the lens, it is only required to make setting so that, for example, the imaging area of the CCD camera 42*a* defined by the lens after being moved substantially matches with the imaging area 42*f* of the CCD camera 42 shown in FIG. 4A. In this state, if imaging is carried out using the CCD cameras 42, 42*a* on both the right-hand side and the left-hand side, it is possible to obtain face image data capable of representing the face of the illegal player H stereoscopically based on the face image data output from each of the CCD cameras 42, 42*a*. In this case, it is possible to realistically show features such as bumps and dips, outline, etc., of the face, which are difficult to confirm from the two-dimensional face image data. Due to this, it is possible to obtain information about illegal action with higher reliability.

Although the number of times of imaging of the face of the illegal player H is not referred to in the embodiment described above, it may also be possible to image the face of the same illegal player H two or more times. By doing so, it is possible to identify further details of the face of the illegal player H. Further, if the illegal player H repeats illegality many times, the face image data is obtained each time and put into a database, thereby it is possible to manage the history of illegality of the illegal player H. Due to this, it is possible to prevent illegal actions by detecting them quickly and accurately.

When the face of the same illegal player H is imaged two or more times, it is more efficient to totally manage the face image data as a history of the same illegal player than to manage the respective face image data separately. To do this, it is necessary to determine that the two or more face image data are those of the same person. For example, if an illegal player who has once played an illegal game in the game arcade comes to the game arcade again and plays an illegal play, the determination whether or not the person is the same is carried out by comparison between the face image data of the illegal player obtained in the past and the face image data newly obtained. Even in the case where the person is the same, if he/she is dressed differently from when he/she appeared in the game arcade before, determination as to whether or not the person is the same is made by comparison of the features of the face. At this time, as comparison determination processing, it is only required to apply the already existing well-known face recognition processing method.

Figure 6A:
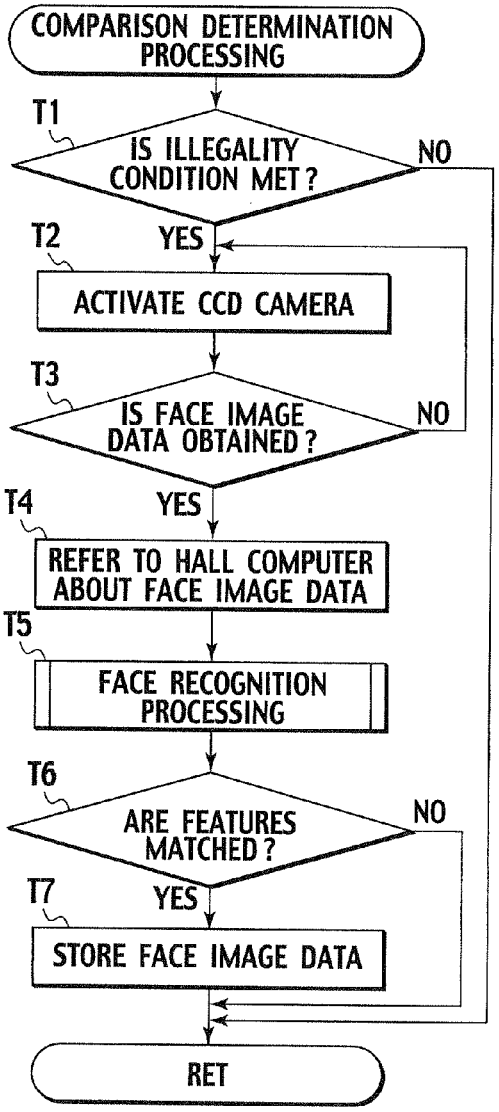
FIG. 6A is a diagram showing an operation flow of comparison determination processing and FIG. 6B is a diagram showing an operation flow of face authentication processing.

An example of the comparison determination processing in the sandwiched device of pachinko gaming machine 8 (FIG. 3) is explained with reference to FIGS. 6A and 6B. The comparison determination processing is explained on the assumption that the face image data of an illegal player obtained in the past is stored in a hard disc (not shown) of the hall computer HP (FIG. 1) and managed as data associated with each of the illegal players. A series of operations of the comparison determination processing is executed in the CPU 22 by, for example, a comparison determination program stored in the ROM 24 of the sandwiched device 8 using the RAM 26 as a working area.

Similar to the embodiment described above, when the illegality condition is met (T1), the CCD camera 42 is activated to image the illegal player H (FIG. 5) (T2). At this time, when new face image data of the illegal player H is obtained (T3), for example, the CPU 22 of the sandwiched device 8 refers to the hall computer HP about the face image data and executes the face authentication processing (T4, T5). Here, the newly obtained face image data is compared with the face image data of a number of illegal players stored in the hall computer HP and whether or not they match with each other is determined (T6). As a working area for comparison, for example, the RAM 26 of the sandwiched device 8 may be used, or the RAM (not shown) of the hall computer Hp may be used.

Then, if it is determined that there is data that matches with the newly obtained face image data among the large amount of the face image data already stored in the hall computer HP, an illegal player corresponding to the face image data is identified. At this time, the newly obtained face image data is stored in the hard disc (not shown) of the hall computer HP as information about illegal play corresponding to the identified illegal player (T7). Due to this, it is made possible to totally manage the history of illegal plays the same illegal player played and as a result, it is possible to prevent illegal actions by detecting them quickly and accurately.

Figure 6B:
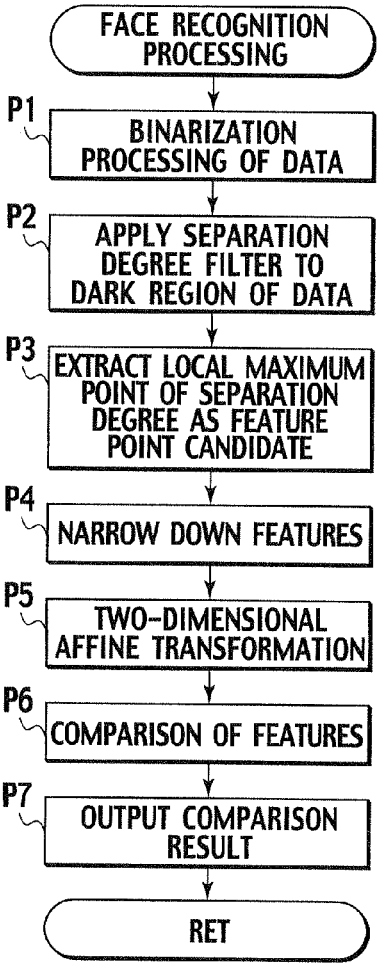

As a method of authenticating a face in the comparison determination processing described above, various methods already known can be applied, and here, as an example, the binarization processing method, in which face image data is divided into a light region and a dark region is adopted as shown in FIG. 6B.

In the face authentication processing, a threshold value is set for the newly obtained face image data (new data) and the face image data (old data) stored in the hall computer HP and each data is separated into the light region and the dark region (binarization processing) (P1). Here, the light region includes a part corresponding to the skin of a face and the dark region includes parts other than the skin (hair, eyebrow, mustache, etc.). As threshold value setting processing, for example, a mode method, p-tile method, determination analysis binarization method, etc., may be applied.

After that, a separation degree filter is applied to each pixel in the dark region and the degree of separation is calculated (P2) and then, a local maximum point of the degree of separation is extracted as a feature point candidate (P3). Feature point candidates include, for example, pupil, naris, tip of nose, mouth end, inner canthus, outer canthus, eyebrow end, etc. Then, by pattern comparison using a partial space method, the features of new data and old data are narrowed based on the position, shape, etc., of each feature point candidate (P4).

Next, by executing the two-dimensional affine transformation, the face image included in the new data and the old data is recognized (P5). Then, based on both the data, whether or not the features match with each other is determined (P6) and the result of the determination is output (P7).

It is also possible to configure the system so that such comparison determination processing can be executed by, for example, the counter 46 or the POS terminal 48.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A peripheral device for a wagering machine, comprising:
an imaging unit including a lens; and
an actuator moving the lens; and
a controller for operating said imaging unit;
wherein said imaging unit is positioned to capture a facial image of a player of the wagering machine;
wherein the controller is configured to implement the following steps:
(a) monitoring, continuously during a period of playing a game, information about a game which is outputted from a main substrate of the wagering machine when the player plays with the wagering machine, the information being at least one selected from a group consisting of amount of money inserted in the wagering machine for game play, gaming time, a number of times of wins, and a number of times of bonuses;
(b) determining whether or not an improper condition is met based on whether or not the information about the game matches to a predetermined improper condition for the game which the player plays;
(c) activating the imaging unit to start operation when it is determined the improper condition is met;
(d) activating the actuator to move the lens of the imaging unit after starting operation; and
(e) outputting the captured facial image data of the player to compare with stored facial image data.

2. The peripheral device according to claim 1, further comprising: an action notification unit configured to report an action to a third party when it is determined the improper condition is met.

3. A method of detecting an action using a peripheral device for a wagering machine, comprising the steps of:
monitoring, continuously during a period of playing a game, information about the game which is outputted from a main substrate of the wagering machine when a player plays with the wagering machine by a controller provided in the peripheral device, the information being at least one selected from a group consisting of amount of money inserted in the wagering machine for game play, gaming time, number of times of wins, and number of times of bonus;
determining, by the controller, whether or not the information about the game meets an improper condition based on whether or not the information about the game matches to a predetermined improper condition for the game which the player plays;
capturing a face image of a player who plays the game with the wagering machine by using an imaging unit provided in the peripheral device with moving a lens in the imaging unit by an actuator when the information about the game meets the improper condition based on the determination result by the controller; and
outputting the captured face image of the player to compare with stored face image data.

4. The peripheral device according to claim 1, wherein the imaging unit is configured to output the captured facial image of the player, which is related to a wagering machine identifying data predetermined for identifying the wagering machine.

5. A peripheral device for a wagering machine, comprising:
an imaging unit including a lens;
an actuator moving the lens; and
a controller for operating said imaging unit;
wherein said imaging unit is positioned to capture a facial image of a player of the wagering machine;
wherein the controller is configured to implement the following steps:
(a) monitoring, continuously during a period of playing a game, information about a game which is outputted from the wagering machine as a result of an operation of the wagering machine or for the operation of the wagering machine when the player plays with the wagering machine, the information being at least one selected from a group consisting of amount of money inserted in the wagering machine for game play, gaming time, number of times of wins, and number of times of bonus;
(b) determining whether or not an improper condition is met based on whether or not the information about the game matches to a predetermined improper condition for the game which the player plays;
(c) activating the imaging unit when it is determined the improper condition is met;
(d) activating the actuator to move the lens of the imaging unit after starting operation; and
(e) outputting the captured facial image data of the player to compare with stored facial image data.

6. A method of detecting an action using a peripheral device for a wagering machine, comprising the steps of:
monitoring, continuously during a period of playing a game, information about the game which is outputted from the wagering machine as a result of an operation of the wagering machine or for the operation of the wagering machine when the player plays with the wagering machine by a controller provided in the peripheral device, the information being at least one selected from a group consisting of amount of money inserted in the wagering machine for game play, gaming time, number of times of wins, and number of times of bonus;

determining, by the controller, whether or not the information about the game meets an improper condition based on whether or not the information about the game matches to a predetermined improper condition for the game which the player plays;

capturing a face image of a player who plays the game with the wagering machine by using an imaging unit provided in the peripheral device with moving a lens in the imaging unit by an actuator when the information about the game meets the improper condition based on the determination result by the controller; and (d) outputting the captured facial image data of the player to compare with stored facial image data.

7. A peripheral device for a wagering machine, comprising:

an imaging unit including a lens;

an actuator moving the lens; and a controller for operating said imaging unit;

wherein said imaging unit is positioned to capture a facial image of a player of the wagering machine;

wherein the controller is configured to implement the following steps:

(a) monitoring, continuously during a period of playing a game, information about a game which is outputted from a main substrate of the wagering machine when the player plays with the wagering machine, the information being at least one selected from a group consisting of amount of money inserted in the wagering machine for game play, gaming time, number of times of wins, and number of times of bonus;

(b) determining whether or not an improper condition is met based on whether or not the information about the game matches to a predetermined improper condition for the game which the player plays;

(c) activating the imaging unit when it is determined the improper condition is met;

(d) activating the actuator to move the lens of the imaging unit after starting operation; and (e) outputting the captured facial image data of the player to compare with stored facial image data.

8. A method of detecting an action using a peripheral device for a wagering machine, comprising the steps of:

monitoring, continuously during a period of playing a game, information about the game which is outputted from a main substrate of the wagering machine when the player plays with the wagering machine by a controller provided in the peripheral device, the information being at least one selected from a group consisting of amount of money inserted in the wagering machine for game play, gaming time, a number of times of wins, and a number of times of bonuses;

determining, by the controller, whether or not the information about the game meets an improper condition based on whether or not the information about the game matches to a predetermined improper condition for the game which the player plays;

capturing a face image of a player who plays the game with the wagering machine by using an imaging unit provided in the peripheral device with moving a lens in the imaging unit by an actuator when the information about the game meets the improper condition based on the determination result by the controller; and outputting the captured facial image data of the player to compare with stored facial image data.

* * * * *